United States Patent [19]

Badiali

[11] Patent Number: 4,494,367

[45] Date of Patent: Jan. 22, 1985

[54] SPLICER DEVICE TO DISASSEMBLE AND RECOMPOSE YARN MECHANICALLY

[75] Inventor: Roberto Badiali, Pordenone, Italy

[73] Assignee: Officine Savio S.p.A., Pardenone, Italy

[21] Appl. No.: 439,323

[22] Filed: Nov. 4, 1982

[30] Foreign Application Priority Data

Nov. 4, 1981 [IT] Italy ..... 83493 A/81
Sep. 30, 1982 [IT] Italy ..... 83456 A/82

[51] Int. Cl.[3] ..... B65H 69/06; D01H 15/00
[52] U.S. Cl. ..... 57/22; 57/261
[58] Field of Search ..... 57/22, 23, 202, 261–267

[56] References Cited

U.S. PATENT DOCUMENTS

| | | | |
|---|---|---|---|
| 1,345,375 | 7/1920 | Lemay | 57/22 |
| 1,463,401 | 7/1923 | Pearson et al. | 57/22 |
| 1,572,655 | 2/1926 | Pearson et al. | 57/22 |
| 1,950,658 | 3/1934 | Cavanagh et al. | 57/22 |
| 2,028,144 | 1/1936 | Cavanagh | 57/22 |
| 3,307,339 | 3/1967 | Porter | 57/22 |
| 4,341,065 | 7/1982 | Baumgartner et al. | 57/202 X |
| 4,341,066 | 7/1982 | Baumgartner et al. | 57/202 X |
| 4,386,494 | 6/1983 | Felix | 57/22 |
| 4,407,117 | 10/1983 | Garnsworthy | 57/22 |

FOREIGN PATENT DOCUMENTS

| | | |
|---|---|---|
| 39609 | 11/1981 | European Pat. Off. . |
| 1919149 | 10/1969 | Fed. Rep. of Germany . |
| 2025555 | 1/1980 | United Kingdom . |
| 2083090 | 3/1982 | United Kingdom . |

*Primary Examiner*—John Petrakes
*Attorney, Agent, or Firm*—Stevens, Davis, Miller & Mosher

[57] ABSTRACT

Splicer device to disassemble and recompose yarn mechanically whereby said device comprises belts to untwist-retwist the yarns to be spliced, the yarns undergoing an untwisting action in a position of mutual non-interference and an action of removal and discharge of excessive tail ends and also a retwisting action, a hook to displace sideways at least one of the yarns, an intermediate clamp, a securing and tearing cutter, retwisting belts, and a suction discharge for the tail ends.

20 Claims, 17 Drawing Figures

SPLICER DEVICE TO DISASSEMBLE AND RECOMPOSE YARN MECHANICALLY

This invention relates to a splicer device to disassemble and recompose yarn mechanically.

The device of the invention acts according to the procedure described partially in application No. 0039609 for a European patent as published on the 11th. November 1981.

In the device of the patent application the means employed to untwist and retwist the yarn consist of a pair of counter-rotating disks.

Moreover, in the device, so as to make the splice, the tracts of yarn to be joined together are introduced between opened disks and are positioned in two directions crossing over each other along diameters of the disks.

Then the disks are closed together and actuated in the first phase of the cycle and rotate in opposite directions to each other so as to untwist the tracts of yarn.

After the excessive tail ends to be removed from the yarn have been eliminated and the remaining tails have been formed on each end of the yarn within the disks, each disk is actuated in a direction opposite to that of the first phase of the cycle so as to perform the retwisting.

Owing to the disk-shaped conformation of the means employed to untwist and retwist the yarn, the tracts of the two yarns comprised between the disks have to take up positions along diameters of the disks which cross over each other within the disks, at least in the untwisting phase, if the device is to work properly.

This involves interference of the ends of the yarn at the crossover point and also incomplete mutual overlaying and mutual penetration of the fibers of the remaining tails. These shortcomings have an unfavourable effect on the quality of the splice made by the device.

An object of the invention is to provide a splicer device to disassemble and recompose yarn mechanically whereby the device overcomes the foregoing technical drawbacks and makes a splice of an excellent quality.

One advantage of the invention is that the yarns are untwisted in a position of mutual non-interference.

Another advantage of the device of the invention is the ability to vary, depending on the type of yarn to be spliced, the length of the splice so as to make it suitable for the length of the fibers.

Untwisting and retwisting respectively mean the operations which remove the twists comprised in a yarn and which restore the twists.

Hereinafter untwisting shall therefore mean an action of removing the twists advantageously as far as a nil value or negative twist which may reach a value of 100% of the positive starting twist or even more.

Retwisting, on the other hand, shall mean the operation of restoring to the spliced yarn twists which may be the same as or almost the same as or greater than the original twists.

According to one aspect of the invention the untwisting and retwisting of the two yarns are performed by untwisting-retwisting means.

According to the invention the untwisting-retwisting means consist of opposed belts or pads facing each other and able to move in opposite directions, and the yarns become engaged between them. Alternatively untwisting-retwisting means consist of rotating means such as grooved cylinders or disks or rotating grippers or mechanical equivalents thereof, with which the yarns cooperate at least temporarily.

According to another aspect of the invention the device of the invention comprises intermediate clamping means which are advantageously such as to determine the points for clamping the untwisted tract of yarn so that the length of the fibers of the remaining tails is not such as to protrude from the device itself.

The clamping points will therefore be distanced from the untwisting-retwisting means in relation to the length of the fibers themselves so that the fibers of the remaining tails will not protrude from the device itself.

According to yet another aspect of the invention the device comprises means to grip and tear the excessive tail ends and also, advantageously, means to discharge the latter.

The plucking and tearing of the excessive tail ends take place advantageously with the yarns clamped securely by the intermediate clamping means and with the untwisting means exerting a low pressure or no pressure on the yarns so as to assist the action of plucking the fibers.

Owing to the plucking and tearing action as carried out, which is such as to leave the lengths of the fibers substantially within the device, the fibers of each remaining tail have a frayed, tapered aspect, which helps cohesion and cooperation with the fibers of the neighboring yarn.

The splice is then completed by retwisting the two coupled yarns. According to yet another aspect of the invention this is carried out by retwisting means, which cooperate advantageously with the untwisting-retwisting means in the retwisting phase.

The retwisting means are positioned between the untwisting-retwisting means. They may be conformed belt-wise, diskwise or plate-wise or may have other shapes, and each of them has a surface able to cooperate with a surface of the facing retwisting means.

If the retwisting means are disk-wise, they can be flat or comprise contoured portions of various conformations, as is described more fully hereinafter.

If the retwisting means have the form of sliding belts or pads, they can be flat or variously conformed with sectors or zones or ridges.

One retwisting means can cooperate with another like retwisting means or with another different retwisting means.

The retwisting means may comprise processing means able to act on the yarn itself during the retwisting phase.

The processing means may consist, for instance, of oblique sectors, or ridges, or protrusions if the retwisting means are flat, or else may consist of variously arranged annular sectors, or sectors of spirals, or the like if the retwisting means are disk-like.

When the processing means are comprised, they make possible a continuous, gradual re-rolling action working progressively along the axis of the yarn and on the yarn itself, together with a substantially tangential, or advantageously tangential and axial, action moving from the middle of the tract of the yarn involved towards the edge thereof in an even and progressive way.

The pressure exerted on the yarns causes a mechanical concentration of the fibers and also enables the hairy portion of the yarns to be united to the fibers, thus providing a better bond, amongst other things.

In the device of the invention the retwisting means may be paired so as to have facing retwisting means both of the same type or of different types.

According to a further aspect of the invention said device may include auxiliary means. The auxiliary means, for instance, may perform heating of the spliced tract, thereby enabling the splice itself to be stabilized and kept substantially constant in the long term.

The heating action may be carried out with microwaves, electrostatic or dielectric charges, heated or radiant plates, electrical discharges, fluids at a given temperature, and so on, as the means employed to create the desired heating action are not relevant as regards the economics of the invention.

Auxiliary means may produce an action of mutual penetration of the fibers of the two yarns, whereby suitable mutual penetration means such as comb means, or tooth means, or brush means, or a mixture thereof may be included among the auxiliary means.

The auxiliary means may also comprise means with a nozzle, or nozzles, fed with a jet of liquid under pressure, perhaps at a given temperature and/or containing additives.

The auxiliary means will work advantageously inside between the intermediate clamping means, but can work at any desired position within the untwisting-retwisting means.

According to yet another aspect of the invention, pins, shafts, studs, protrusions or equivalent means can be comprised in cooperation with at least one of the untwisting-retwisting means and can perform the task of bringing yarns together and pushing one of them towards the other.

According to the invention the various means to move the untwisting-retwisting means, the means to actuate the retwisting means, the means to actuate the means that displace at least one of the yarns sideways, and the means to clamp and to displace the securing and tearing means can be obtained through the coordinate cooperation of a plurality of cams, or a plurality of levers, or a plurality of jacks, or by means of other mechanical means of a known type, or with a joint combination of the means.

The untwisting-retwisting means and the retwisting means cooperate advantageously in a coordinated way, so that the motion of one of them affects the others.

The invention is therefore embodied with a splicer device to disassemble and recompose yarn mechanically, whereby the splicer device comprises means to untwist-retwist the yarns to be spliced and the yarns undergo an untwisting action in a position of mutual non-interference and an action for removing and discharging excessive tail ends and also a retwisting action, said splicer device being characterized by including in cooperation:

means to displace at least one of the two yarns sideways,
intermediate clamping means,
securing and tearing means,
retwisting means and
discharge means.

Other details and features of the invention will stand out from the description given below by way of non-limitative example and with reference to the accompanying drawings, in which.

Figure 7A:
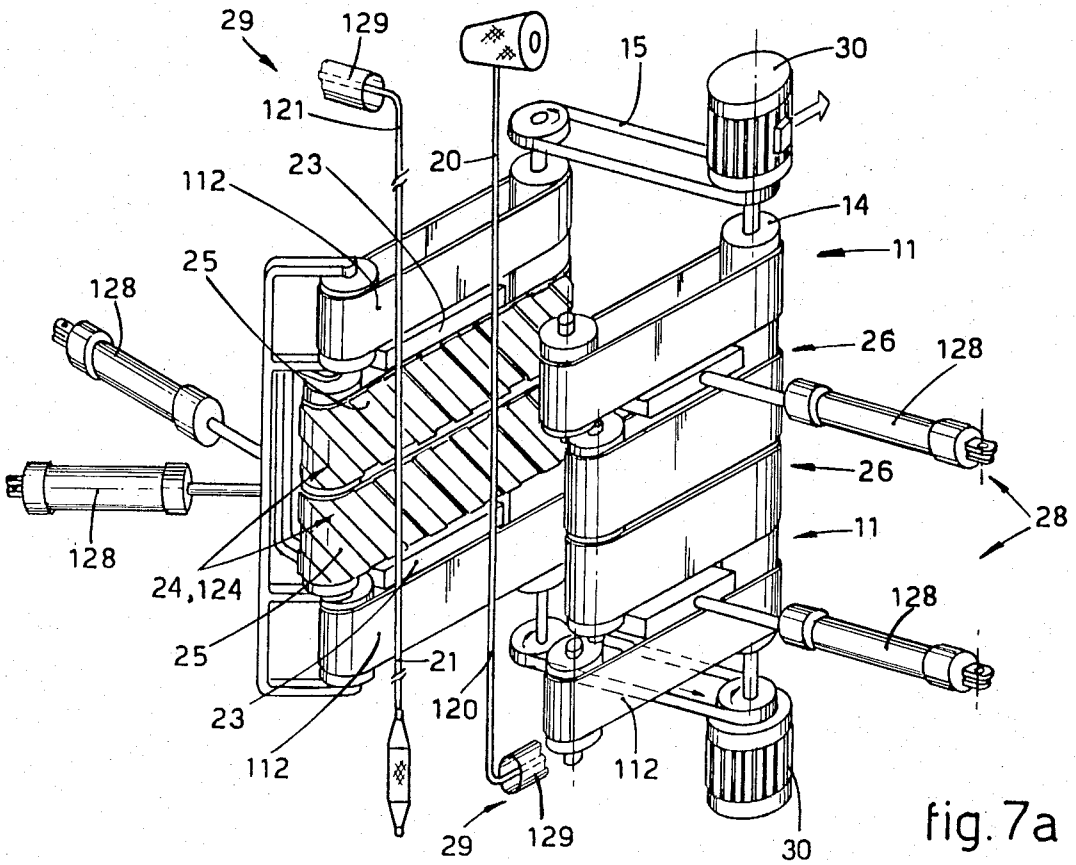
Figure 8B:
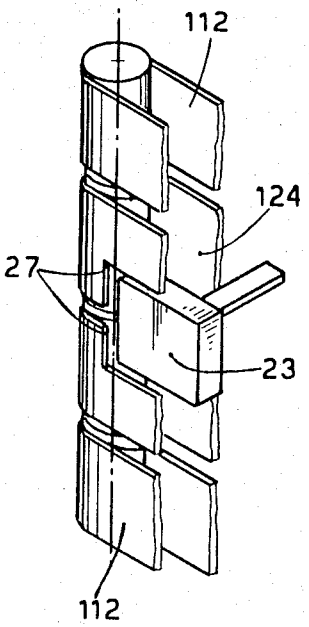
Figure 8A:
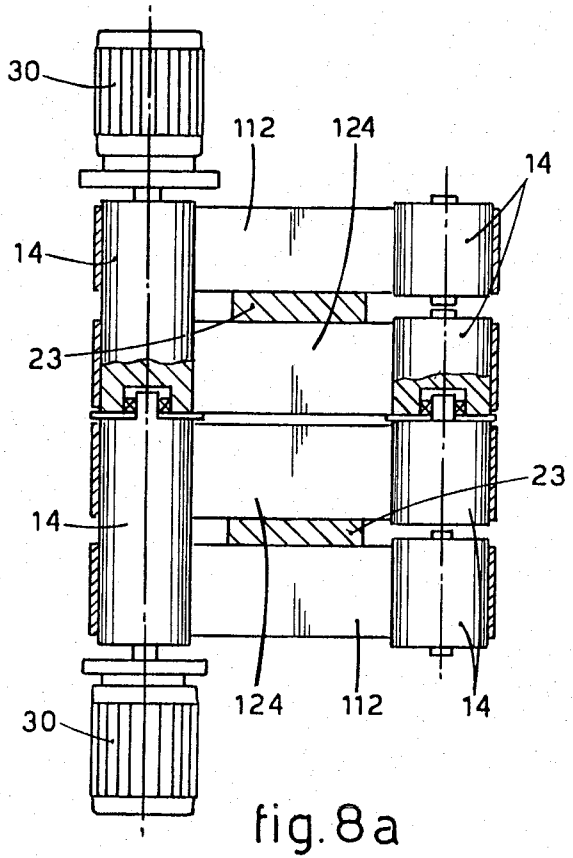
Figure 7B:
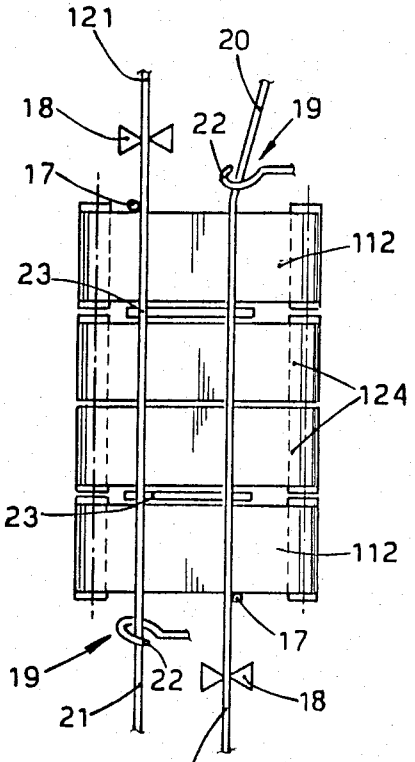
Figure 11A:
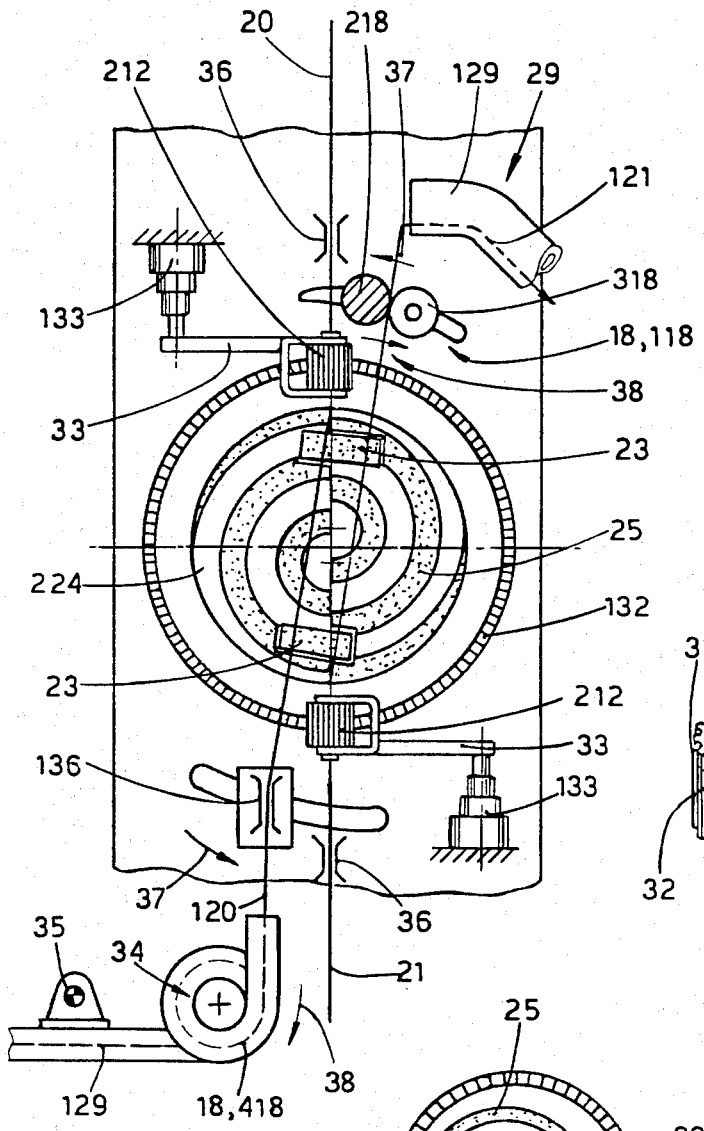
Figure 11B:
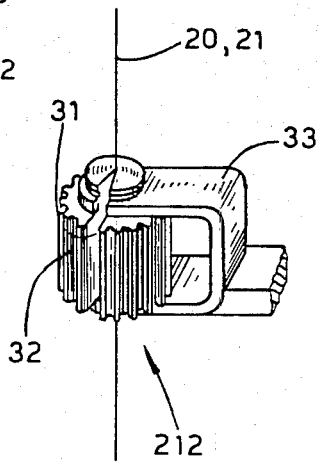
Figure 12:
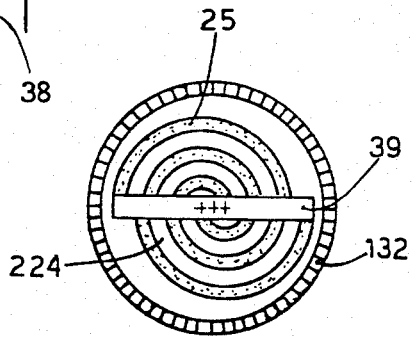

FIG. 7*a* shows the arrangement of the retwisting means in the device of the foregoing figures;

FIG. 7*b* is a front view of one half of the device so as to show the sideways displacement means, the securing and tearing means and also the intermediate clamping means and retwisting means;

FIG. 8*a* shows a partial section of the device, wherein the pulleys can be seen;

FIG. 8*b* shows a possible disposition of the intermediate clamping means;

FIGS. 9*a*, 9*b*, 10*a*, and 10*b* show phases of the working of the device;

FIGS. 11*a* and 11*b* show a variant of the invention;

FIG. 12 shows a possible arrangement of auxiliary means.

In the figures the same parts or parts having the same functions bear the same reference numbers.

Figure 1:
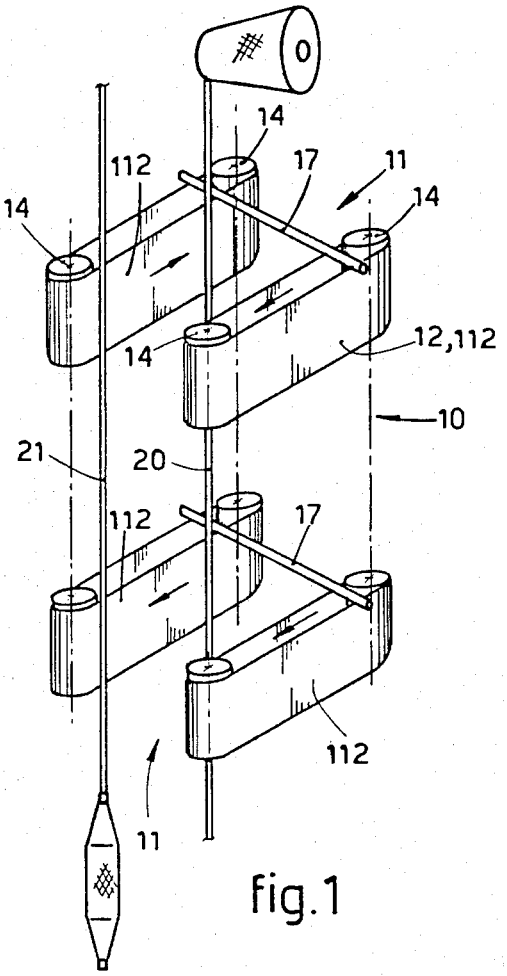
FIG. 1 shows a partial three-dimensional view of a splicer device according to the invention with the untwisting-retwisting means spaced apart so as to make evident the constructional features of the splicer device.
Figure 3:
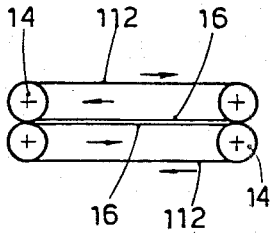
FIGS. 3 and 4 show the action of the untwisting-retwisting means on the yarn diagrammatically.
Figure 2:
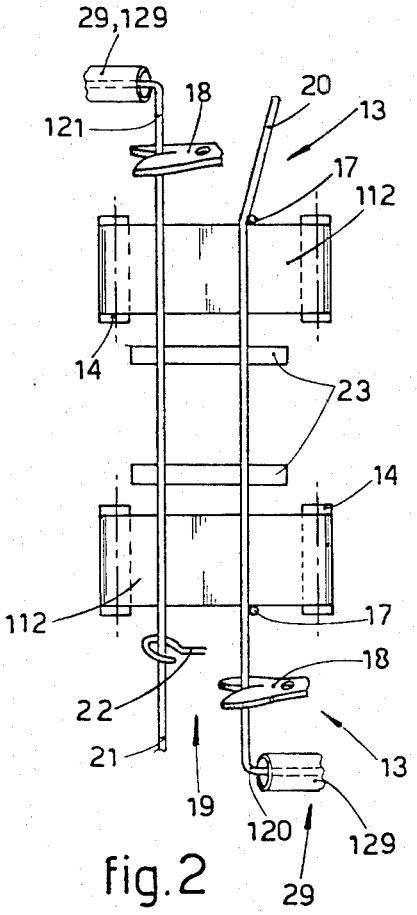
FIG. 2 shows a section of the splicer device of FIG. 1 wherein can be seen the means to position the ends of the yarns between the untwisting-retwisting means, and also the intermediate clamping means and discharge means.
Figure 4:
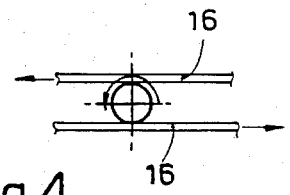

The splicer device 10 to disassemble and recompose the yarn mechanically according to the invention comprises two pairs 11 of untwisting-retwisting means 12, which are belt means 112, and also means 13 to position and tear the excessive tail ends (FIGS. 1–2).

The pairs 11 of belt means 112, hereinafter also just called "belts", can be mutually spaced apart advantageously in a direction lengthwise in relation to the yarns 20,21 so as to suit the length of the tracts of the yarns 20,21 where it is wished to make the splice.

In the Figures shown the belts 12 are stretched on pulley means 14, which are coordinated and actuated here with belts 15.

According to the invention suitable stiff sliding surfaces (not shown here) are located between the pulleys 14 of each belt 112 along the portions 16 of the belts and will be such as can resist any deflection of the portions 16 of the belt 112.

The belts 112 are actuated in such a way that the facing portions 16 run in opposite directions, thereby generating between each pair 11 a rotation of the yarns 20,21 which determines, depending on the directions of coordinated running of the belts 112, the untwisting or retwisting of the portions of the yarns 20,21 to be spliced which are comprised lengthwise between the pairs 11 of belts 112.

The structure of the belt means 112 employed in untwisting and retwisting of the yarns 20,21 to be spliced enables the yarns 20,21 to be advantageously positioned parallel within the device 10.

According to the invention the yarns can also be arranged side by side but not parallel or even crossed over each other.

The positioning and tearing means 13 comprise, in FIG. 2, guide means 17, securing and tearing means 18, or equivalents thereof, and means 19 to displace sideways at least one of the two yarns 20,21 to be spliced, whereby the latter means 19 can consist, for instance, of a hook means 22, or equivalent means, able to slide crosswise to the yarns 20,21 and of means to displace crosswise (not shown here) the securing and tearing means 18 cooperating with the hook means 22.

So as to splice the two yarns 20,21, one of the yarns 20 is aligned and kept taut on the guide means 17 by a securing and tearing means 18, which holds the relative tail end 120, whereas the other yarn 21 is positioned by the other securing and tearing means 18, which holds the relative tail end 121 (FIG. 2).

Figure 9A:
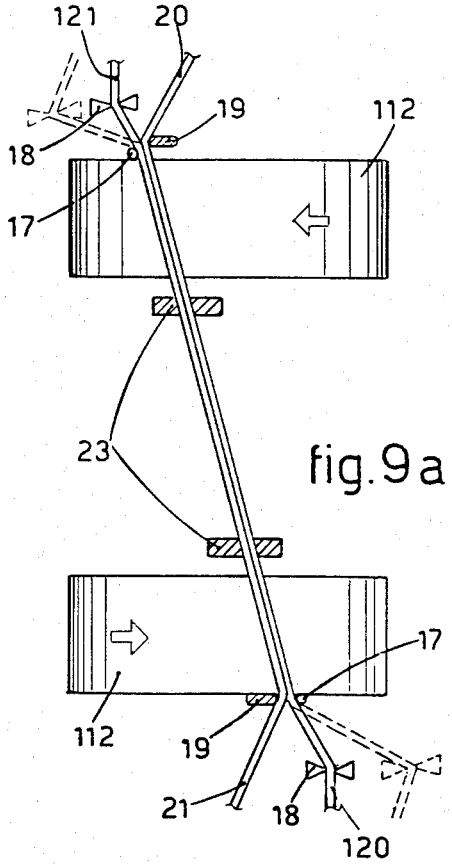
Figure 9B:
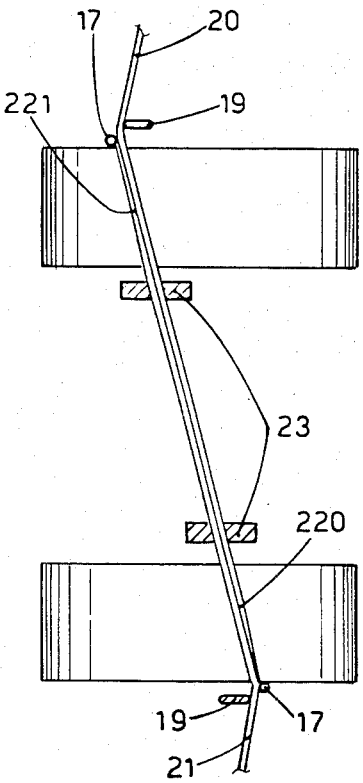

Or else the sideways displacement means 19 can act on both the yarns and bring them together as in FIGS. 9*a* and 9*b*, the guide means 17 being arranged as in FIGS. 7*b* and 9.

According to the latter arrangement each of two yarns 20,21 cooperates with a sideways displacement means 19 consisting of a hook means 22, for instance.

According to the latter arrangement the securing and tearing means 18 are able not to cooperate in bringing the yarns 20,21 together but can be working only in the phase of plucking and tearing the yarns.

The actuation of the belt means 112 leads to the untwisting of the two tracts of yarns 20,21 contained between the belt means 112.

Thereafter the yarns 20,21 to be spliced are coupled and aligned on the guide means 17 owing to the sideways displacement of the yarn 21 by the hook means 22 in cooperation with the relative securing and tearing means 18 engaging the yarn 21 (FIG. 2), or owing to the sideways displacement of both yarns 20,21 by the means 19 (FIG. 9*a*).

Intermediate clamping means 23, which in FIG. 2 are positioned between the two pairs 11 of the belt means 112, have the task of clamping the yarns 20,21 at a desired tract comprised between the clamping means 23.

The purpose of this is to permit the plucking and tearing of the excessive tail ends 120,121 while the means 112 are slackened off, thereby obtaining tapered tails which do not protrude from the device but without losing the negative twists imparted to the tracts of yarn 20,21 contained between the clamping means 23.

The intermediate clamping means 23 can be actuated in coordination with the other parts of the device by levers, cams, jacks or other suitable means.

The actuation of both the securing and tearing means 18 causes the plucking and tearing of the respective excessive tail ends 120,121 from the yarns 20,21 and the resulting formation of two tapered tails in the portions of the yarns 20,21 contained respectively between one pair 11 of belts 112 and the other pair.

Figure 5:
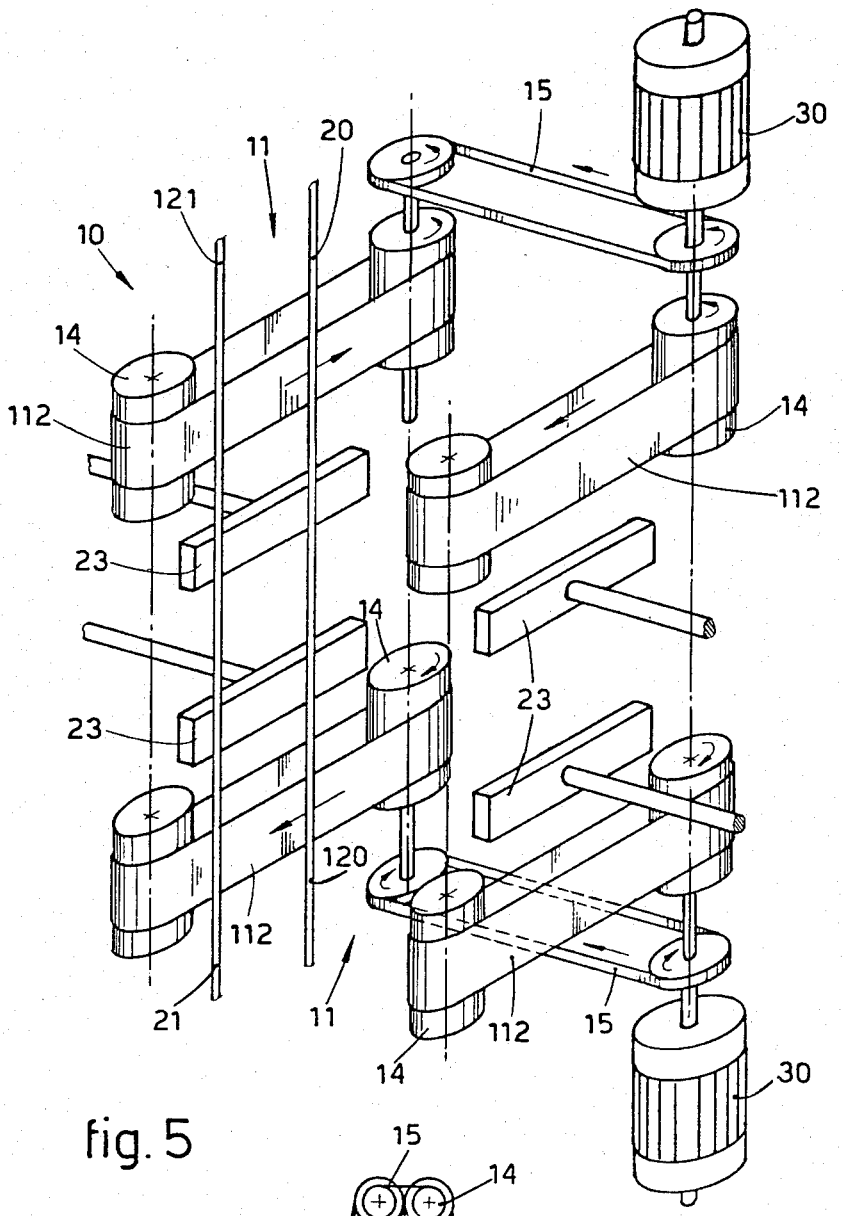
FIG. 5 is a view of the splice device of the invention with the untwisting-retwisting means spaced apart for the same reasons as with FIG. 1, whereby the view makes evident the belt means actuating the two pairs of untwisting-retwisting means and also the intermediate clamping means 23.

Each pair 11 of belt means 112 is actuated in FIG. 5 by a motor means 30 connected by belt means 15 to one pulley 14 of each belt means 112.

Figure 10:
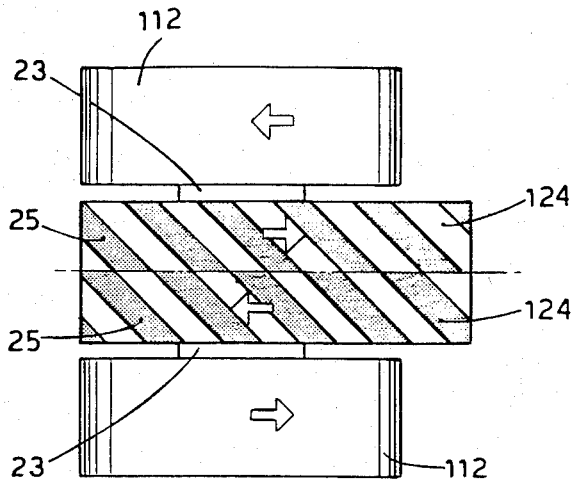
Figure 10B:
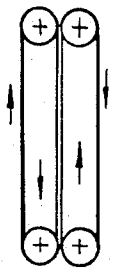

FIG. 7*a* shows retwisting means 24 cooperating with the belts 112 during the phase of retwisting the yarns 20,21 (FIG. 10).

In the Figure the retwisting means 24 are retwisting belt means 124 arranged in pairs 26, the belt means 124 of each pair 26 being opposite to each other and rotating in opposite directions to each other.

Figure 6:
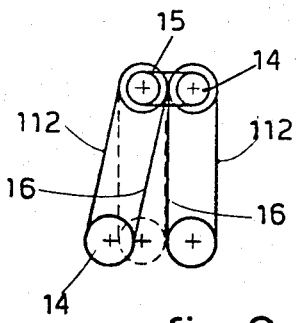
FIG. 6 is a plan view of the position of opening of a pair of untwisting-retwisting means on the introduction and withdrawal of the yarn into and from the splicer device of the invention.

In this instance, so as to introduce the yarns 20,21 to be spliced and to withdraw the spliced yarn, the belt means 112 of each pair 11 and the retwisting means 24 of each pair 26 are able to open at an angle to each other as shown in FIG. 6, thus keeping advantageously a constant distance between the centers of the two pulleys 14 which receive motion from the belt 15.

The intermediate clamping means 23 can be variously arranged in relation to the means 124 and can be outside them 124 (FIG. 7*a*) or else can cooperate with openings or slots 27 comprised in the means 124 (FIG. 8*b*).

The openings 27 coincide with the yarns 20,21 when untwisting has taken place so as to enable the clamping means 23 to cooperate with the yarns 20,21.

The retwisting means 24 cooperate with the untwisting-retwisting means 12 in the retwisting phase and exert pressure on the coupled yarns 20,21, so that the fibers become concentrated and a compact joint is obtained.

The retwisting means 24 are equipped advantageously with processing means 25, which in the Figure have oblique sectors and have the purpose of applying a mixed tangential and axial action to the yarns 20,21. The purpose thereof is to improve the winding and to draw the surface fibers lengthwise as well.

The processing means 25 consist advantageously of a material which has a high friction coefficient in relation to the yarn but a low friction coefficient in relation to itself.

The clamping means 23, retwisting means 24 and belts 112 are pressed against the yarns 20,21 by suitable pressing means 28 (FIG. 7*a*) during their respective working phases.

In the Figure shown the means 28 consist of a plurality of jacks 128 but could consist of a plurality of levers, cams, rods or other equivalent means which are actuated mechanically, electrically, penumatically or otherwise, or else could consist of any desired combination of the means.

As was said earlier, the belt means 112 can be distanced lengthwise to the yarns 20,21 so as to vary the length of the tract of the yarns 20,21 involved in the splice, depending on the properties of the yarns.

In such a case it is possible to have pairs 26 of retwisting means 24 having differing heights and being capable of being interchanged so as to cooperate with the belt means 112 when the desired distance between the belt means 112 has to be altered.

It is therefore possible to have intermediate clamping means 23 having their position adjustable lengthwise to the yarns 20,21, the adjustment being made with known means not pertinent to the invention.

FIGS. 2 and 7*a* show the means 29 that discharge the excessive tail ends 120,121, the means being suction discharge means 129 in the Figures; but the means 29 can be embodied mechanically or with cooperation between mechanical and pneumatic means.

FIGS. 5, 7*a* and 8*a* show the motor means, or motors, 30 too which cause rotation of the pulleys 14. The motors 30 transmit their motion to the respective pulleys 14, the motion having a different direction for one pulley from that for another pulley.

One motor means alone 30 may also be comprised, the pulleys 14 receiving the motion through suitable transmissions.

FIG. 7*b* shows the guide means 17, securing and tearing means 18 and sideways displacement means 19, which in this case is a hook means 22.

FIG. 8*a* shows a front section of the device so as to show the actuation pulleys.

FIG. 8*b* shows a possible arrangement of the intermediate clamping means 23 cooperating with openings 27 in the retwisting means 124.

According to the invention, after the yarns 20,21 have been untwisted, they are brought alongside each other by the sideways displacement means 19.

Means 19 can cooperate with the belts 112 by bringing the yarns 20,21 progressively nearer to each other until the latter are coupled together at the end of untwisting.

The intermediate clamping means 23 clamp the yarns 20,21 and thus prevent loss of the negative twists applied thereto.

The securing and tearing means 18 perform the plucking and tearing of the excessive tail ends 120,121 (FIG. 9*a*) and obtain tapered remaining tails 220,221 (FIG. 9*b*), the belt means 112 being slackened off.

The excessive tail ends 120,121 are freed by the securing and tearing means 18 and discharged by the discharge means 29.

The yarns 20,21 are then retwisted together by the joint action of the belts 112 and retwisting means 124 (FIGS. 10*a* and 10*b*), the means 23 having been released.

FIGS. 11*a* and 11*b* show a variant of the invention. According to the variant the untwisting-retwisting means 12 consist of cylinder means, or cylinders, 212 provided with a radial notch 31 able to lodge and withhold the yarns 20,21. The cylinders 212 are located diametrically opposite to each other at the outside of the retwisting means 24, and the axes of the cylinders 212 are aligned.

The cylinders 212 also have on their outer surface a toothed sector 32 which meshes with a drive rack 132, which is circular in this case and is on the outside of the retwisting means 24.

In the example shown the retwisting means 24 are disk-wise retwisting means 224.

Processing means 25 are comprised on at least one of the retwisting means 224 and may be of a spiral type or have concentric sectors, eccentric rings or annular sectors offset in relation to a diameter, etc.

Intermediate clamping means 23 are included within the processing means 25 and cooperate therewith and are positioned and work according to the methods detailed earlier.

According to the invention the intermediate clamping means 23 may be independent, as shown earlier, or be obtained in cooperation with the processing means 25.

The intermediate clamping means 23 can have a slightly greater height and be elastically yielding. This makes it possible to act firstly with the clamping means 23 and thereafter to make the means 25 operational by using greater pressure when the disk-wise retwisting means 224 are brought together before the final retwisting.

In FIG. 11*a* shown the cylinders 212 can be moved diametrically in relation to the retwisting means 224 so as to regulate the length of the tract of yarn 20,21 affected by the splice, since the cylinders 212 are supported by brackets 33 connected to regulating means 133, which may be mechanical or pneumatic regulating means or of another type.

The securing and tearing means 18 may be mechanical 118 and consist, for instance, of a pair of rollers 218,318 able to move crosswise to the yarn 20 or 21, which is gripped between them. The rotation of the rollers 218,318 can be stopped so as to withhold the yarn 20 or 21 otherwise, the means 18 can be pneumatic 418.

FIG. 11*a* shows means 218 and means 418, the latter consisting here of a suction intake conformed with a loop 34 for better adherence of the tail end 120 to be torn.

In FIG. 11*a* the intake can be rotated around a pivot 35 so as to perform the plucking and tearing of the tail end 120, which is discharged through 129.

The yarns 20,21 are engaged in the grooves 31 of the respective cylinders 212 and in the securing and tearing means 18, whereby, the yarns 20,21 are positioned by stationary yarn guides 36 and also by movable yarn guides 136 so as to be side by side.

The movable yarnsguide 136 are not needed if the securing and tearing means 18 bring the yarns 20,21 alongside each other with a suitable sideways movement.

The rack 132 imparts to the cylinders 212 a rotation such as to untwist the yarns 20,21 to the degree wished.

The yarns are then brought alongside each other by the movement of the means 118 or 136 in the direction of the arrow 37.

It is made possible to bring the yarns together by acting so that at the end of untwisting the grooves 31 lie on the plane of the yarns 20,31 and face inwards.

The yarns 20,21 are now clamped by the intermediate clamping means 23 cooperating with a disk-wise retwisting means (not shown here) which is opposite to and faces the retwisting means 224.

The plucking and tearing action applied to the tail ends 120,121 is carried out by moving the securing and tearing means 118 or 418 in the direction of the arrow 38, the grooves 31 having been rotated by the rack 132 so as not to let the yarns 20,21 escape from the grooves 31 during the plucking and tearing.

However, it is possible to have also a movement of the securing and tearing means 18 along the axis of the yarns or a joint axial and rotatory movement thereof.

The tail ends 120,121 are discharged by the discharge means 129, but after the release of the means 18 if the latter are mechanical 118.

A rotation in the opposite direction to that of the initial rotation is now imparted to the cylinders 212 in cooperation with the actuation of the retwisting means 224, of which at least one comprises processing means 25, so as to obtain the desired retwisting of the two yarns 20,21.

According to the embodiments of the invention shown, auxiliary means 39 can be employed.

A possible arrangement of the auxiliary means 39 is shown in FIG. 12 in cooperation with disk-wise retwisting means 224.

Some preferential lay-outs of the invention have been described, but variants are possible without departing thereby from the scope of this invention.

Thus parts can be removed or added, or shapes and/or proportions can be changed.

Differing lay-outs described with reference to the various attached figures and to the text can also be combined. Further variants are possible for a person skilled in this field without departing thereby from the basic idea of the invention.

I claim:

1. Splicer device through which yarns pass to mechanically disassemble and recompose yarn having tail ends comprising means to untwist-retwist the yarns to be spliced movable in opposite directions, means for sideways displacement of at least one of two yarns to bring said yarns together after untwisting, clamping means intermediate said untwisting-retwisting means to clamp said yarns in an untwisted condition, securing and tearing means on each side of said untwist-retwist means to pluck and remove excessive tails of each yarn, retwisting means intermediate said untwist-retwist means which together with said untwist-retwist means retwist the yarns, and discharge means on each side of said untwist-retwist means to remove the excessive tails of said yarns.

2. The splicer device to disassemble and recompose yarn mechanically as in claim 1, wherein the untwisting-retwisting means consist of two pairs of belt means arranged substantially crosswise to the direction of the yarns to be spliced, each of said pairs workable on a lengthwise portion of the two yarns and each pair comprises two substantially flat portions within which the yarns are positioned, said portions facing each other and running in opposite directions to each other during the working of the belts.

3. The splicer device to disassemble and recompose yarn mechanically, as in claim 2 including pulley means and sliding surfaces, wherein the belt means are stretched on said pulley means, said sliding surfaces being able to resist any deflection of the portions within said belt means.

4. The splicer device to disassemble and recompose yarn mechanically as in claim 1, wherein the means to displace sideways at least one of the yarns to be spliced consist of a hook means arranged so as to be able to run substantially crosswise to the yarn and of means to displace crosswise the securing and tearing means which cooperates with the same one of said two yarns that is engaged by said hook means, said means for sideways displacement aligning and coupling said yarns after the untwisting of the yarns themselves.

5. The splicer device to disassemble and recompose yarn mechanically as in claim 1, wherein the untwisting-retwisting means are grooved cylinders cooperating at least temporarily with the yarns.

6. The splicer device to disassemble and recompose yarn mechanically as in claim 5, wherein the retwisting means are disk-wise retwisting means.

7. The splicer device to disassemble and recompose yarn mechanically as in claim 6, wherein the disk-wise retwisting means define processing means arranged in sectors of rings on said disk positioned along a single diameter of said disk.

8. The splicer device to disassemble and recompose yarn mechanically as in claim 6, including processing means comprised on the disk-wise retwisting means, said processing means being arranged in sectors of spirals opposite to each other substantially along a diameter.

9. The splicer device to disassemble and recompose yarn mechanically as in claim 1, wherein the retwisting means are retwisting belt means.

10. The splicer device to disassemble and recompose yarn mechanically as in claim 1, wherein the retwisting means have at least one part with a flat surface.

11. The splicer device to disassemble and recompose yarn mechanically as in claim 1, wherein the retwisting means define processing means which improve the rewinding.

12. The splicer device to disassemble and recompose yarn mechanically as in claim 11, wherein the processing means comprised on the retwisting means are arranged in sectors.

13. The splicer device to disassemble and recompose yarn mechanically as in claim 1, wherein the intermediate clamping means cooperate with at least one edge of the untwisting-retwisting means.

14. The splicer device to disassemble and recompose yarn mechanically as in claim 1, wherein the intermediate clamping means are located at a position within the untwisting-retwisting means.

15. The splicer device to disassemble and recompose yarn mechanically as in claim 1, wherein the retwisting means define openings therein and the intermediate clamping means cooperate with the openings in the retwisting means.

16. The splicer device to disassemble and recompose yarn mechanically as in claim 1, wherein the intermediate clamping means consist of at least one element able to move crosswise to the yarns in the retwisting means.

17. The splicer device to disassemble and recompose yarn mechanically as in claim 1, wherein the securing and tearing means are at least partially movable and apply to the yarns, at least in the tract between the untwisting-retwisting means, an axial plucking and tearing action together with removal of excessive tail ends and formation of remaining tails, said remaining tails beginning substantially at about the periphery of the intermediate clamping means and end at about the outside of the untwisting-retwisting means.

18. The splicer device to disassemble and recompose yarn mechanically as in claim 1, including auxiliary means comprised within the untwisting-retwisting means.

19. The splicer device to disassemble and recompose yarn mechanically as in claim 1, wherein the untwisting-retwisting means can be positioned reciprocally in a direction lengthwise to the yarns.

20. The splicer device to disassemble and recompose yarn mechanically as in claim 1, wherein the opposed facing untwisting-retwisting means and opposed facing retwisting means are openable at an angle to enable the yarns to be introduced and the spliced yarn to be withdrawn.

* * * * *